United States Patent [19]

Williams et al.

[11] 4,314,139

[45] Feb. 2, 1982

[54] ELECTRIC BOILER HAVING MEANS FOR CONTROLLING STEAM GENERATION

[75] Inventors: Stanley A. Williams, Dorset, England; Allen R. Tesch, Hubertus, Wis.

[73] Assignee: Aqua-Chem, Inc., Milwaukee, Wis.

[21] Appl. No.: 60,788

[22] Filed: Jul. 25, 1979

[51] Int. Cl.[3] ..... H05B 3/60; F22B 1/30

[52] U.S. Cl. ..... 219/285; 122/4 A; 219/273; 219/287; 219/288; 338/86

[58] Field of Search ..... 219/284–295, 219/271–276; 122/4 A; 338/80–86

[56] References Cited

U.S. PATENT DOCUMENTS

| | | | |
|---|---|---|---|
| 1,597,362 | 8/1926 | Henriksson | 219/287 |
| 2,088,932 | 8/1937 | Stalhame | 219/288 X |
| 4,051,345 | 9/1977 | Eaton | 338/86 X |
| 4,101,758 | 7/1978 | Sprague | 219/289 X |
| 4,109,137 | 8/1978 | Zabelka | 219/288 X |
| 4,169,558 | 10/1979 | Coates | 219/288 X |
| 4,206,342 | 6/1980 | Kuenzli | 219/288 X |

FOREIGN PATENT DOCUMENTS

| | | | |
|---|---|---|---|
| 410256 | 3/1925 | Fed. Rep. of Germany | 219/284 |
| 728299 | 11/1942 | Fed. Rep. of Germany | 219/288 |
| 893172 | 1/1944 | France | 219/284 |
| 45088 | 4/1928 | Norway | 219/286 |
| 57220 | 5/1922 | Sweden | 219/294 |
| 207778 | 2/1940 | Switzerland | 219/288 |

*Primary Examiner*—A. Bartis

*Attorney, Agent, or Firm*—Fred Wiviott

[57] ABSTRACT

An electric boiler includes a first electrode disposed within a chamber and comprising an upwardly oriented water nozzle surrounded by a convolute electrode member. A second electrode is disposed within the chamber vertically above the first electrode and has a bottom center opening for receiving water from the nozzle and a dome for redirecting the same radially outwardly. The second electrode also includes an annular water receptor surrounding said opening and having a plurality of drain openings spaced from the center opening and a plurality of pipe sections of different lengths disposed respectively in said openings for discharging water downwardly onto the convolute electrode member. Control means is connected to the nozzle for varying the water delivery rate therefrom in response to steam pressure in said chamber.

22 Claims, 5 Drawing Figures

ELECTRIC BOILER HAVING MEANS FOR CONTROLLING STEAM GENERATION

BACKGROUND OF THE INVENTION

This invention relates to boilers in more particularly to electric steam boilers wherein water columns flowing between electrodes define a path for steam currents.

One prior art type of electric boiler is shown in U.S. Pat. No. 4,093,846 wherein the current flow path between an energized electrode and a neutral electrode is through downwardly directed water jets and a body of water in the lower end of the boiler chamber. In this device, a portion of the current path is through the water reservoir so that it was necessary to electrically insulate the lining of the vessel. Further, the level of the water in the steam generator had to be controlled so that separate steam generating and reservoir chambers were required. Also, water flow to the energized electrode are in planes generally perpendicular to the vessel axis creating a tangential force on the electrodes. Additionally in such prior art devices the number of current carrying water streams from the energized electrode could not be controlled so that compensation for scale build up could not be achieved.

SUMMARY OF THE INVENTION

It is an object of the invention to provide a new and improved electric steam generator.

A more specific object of the invention is to provide an electric steam generator wherein the current flow path is totally contained within water jets.

Another object of the invention is to provide an electric steam generator wherein electrical insulation of the steam generating chamber walls are not required.

A further object of the invention is to provide an electric steam generator wherein water level within the steam generating chamber is not critical.

Yet another object of the invention is to provide an electric boiler which employs water streams for current conduction wherein the streams are not deflected by gravity and wherein axial loading is minimized.

A still further object of the invention is to provide such a boiler wherein the number of water streams can be adjusted without internal control.

According to one of its aspects, the invention comprises an electric boiler having a vessel for containing a pool of electrically conductive liquid in the lower end thereof and a steam outlet. A first electrode is disposed within the vessel and is adapted to be connected to a high voltage source. A second electrode is spaced from and below the first electrode and above the expected level of the liquid in the pool and includes liquid projecting means for projecting electrically conductive liquid upwardly onto the first electrode in a first continuous stream. Means are provided for delivering liquid from the pool to the liquid projecting means of the second electrode. The first electrode also includes liquid receiving means for receiving and collecting the liquid from the first stream and for redirecting the same back downwardly onto the second electrode in at least one additional continuous stream separate from the first stream and in electric parallelism therewith. The second electrode is also adapted to be connected into an electric circuit having a low electrical potential relative to said high voltage source whereby an electric current will flow through the liquid streams and through the electrodes without passing through the pool of liquid.

Another aspect of the invention comprises a method of generating steam comprising the steps of containing a pool of water in a vessel, energizing a first electrode disposed in an upper region of the vessel from a high voltage source, grounding a second electrode disposed within the vessel and spaced below said first electrode, maintaining the level of water in the pool below the elevation of the second electrode, projecting water from the pool and generally vertically upward from the second electrode onto the first electrode in a first continuous stream, collecting the water from the first stream at the first electrode and directing the same generally vertically downwardly onto the second electrode in at least one additional continuous stream separate from the first stream but in general parallelism therewith, and causing an electric current to flow from the first electrode to the second electrode through the streams in an electrically parallel relation between the high voltage source and ground without passing through the pool for generating steam.

These and other objects and advantages of the present invention will become more apparent from the detailed description thereof taken with the accompanying drawings.

DETAILED DESCRIPTION OF THE PREFERRED EMBODIMENT

Figure 1:
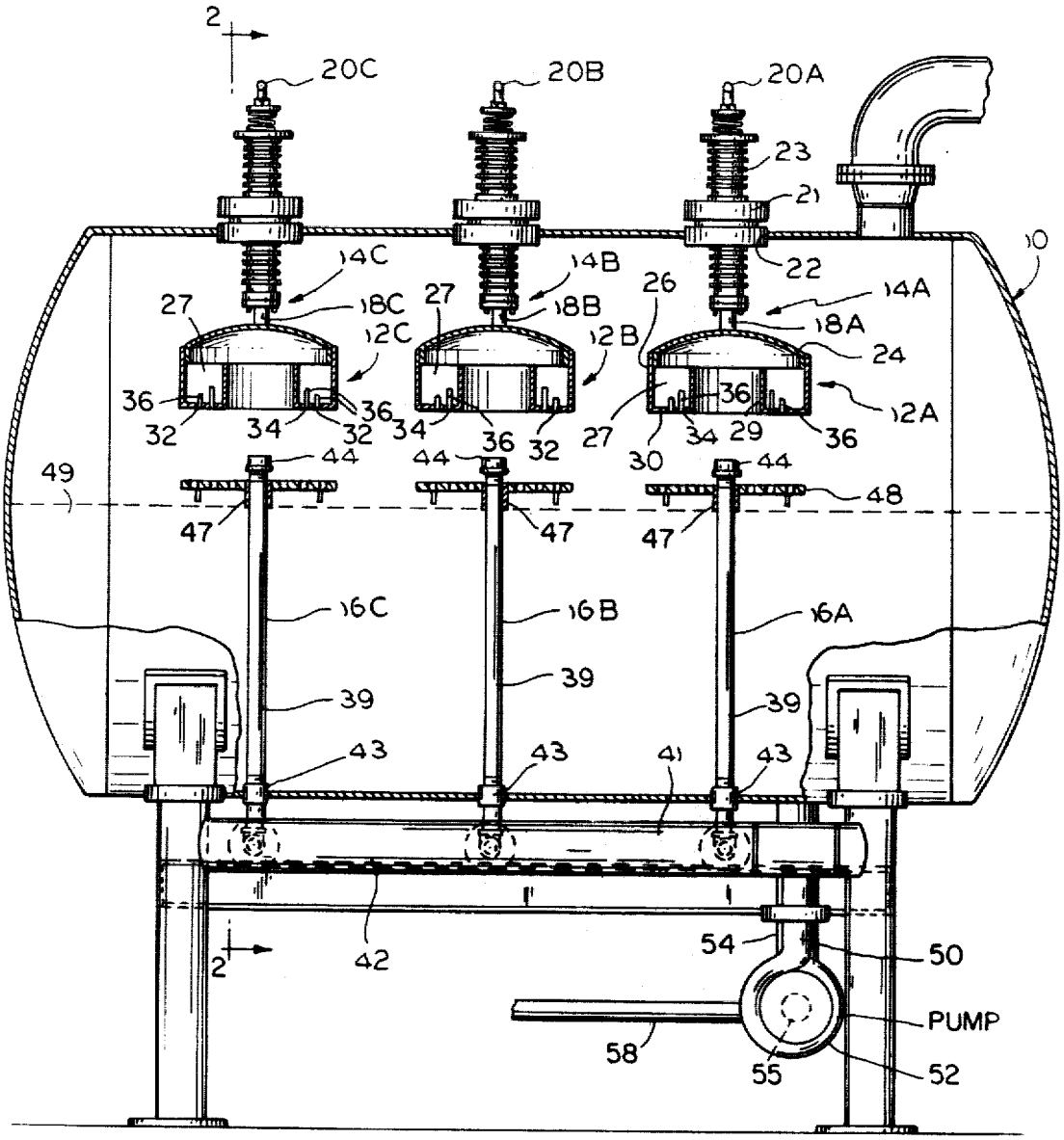
FIG. 1 is side elevational view, partly in section, of an electric steam generator according to the preferred embodiment of the present invention.
Figure 5:
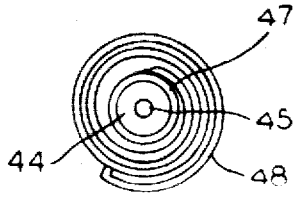
FIG. 5 is a view taken along lines 5—5 of FIG. 2.

FIG. 1 shows the electric boiler in accordance with the present invention to include a metallic vessel 10 for containing three high voltage electrodes 12A, 12B and 12C. The electrodes 12A, 12B and 12C are respectively supported in the vessel 10 by means of insulators 14A, 14B and 14C. Located vertically below the high voltage electrodes 12A, 12B and 12C are grounded neutral electrodes 16A, 16B and 16C, respectively. Extending upwardly through the center of each of the insulators 14A, 14B and 14C are conductors 18A, 18B and 18C which connect electrodes 12A, 12B and 12C, respectively, to conductors 20A, 20B and 20C of a three phase alternating current system.

It will be appreciated that the electrodes and the insulator of each phase are identical and, accordingly, only electrodes 12A and 16A and insulator 14A will be discussed in detail for the sake of brevity. In addition, while the invention will be illustrated and described with respect to a three phase alternating current system, it will be appreciated that the invention is applicable to systems having different numbers of phases.

The insulator 14A may be of any suitable high voltage type and includes a central flange portion 21 for being mounted in a sealing relation within an opening 22 formed in the upper end of the vessel 10. In addition, there is a shell 23 formed of a suitable insulating material, such as porcelain; and which surrounds conductor 18A. Those skilled in the art will appreciate that the insulator 14A insulates the energized conductor 20A, the electrode 12A and the conductor 18A from the electrically grounded vessel 10. In addition, the length of the insulator shell 23 extending upwardly and downwardly from the vessel, and the spacing between insulators 14A, 14B and 14C will be sufficient to prevent an arc over between phases and from any phase to a vessel 10.

Figure 2:
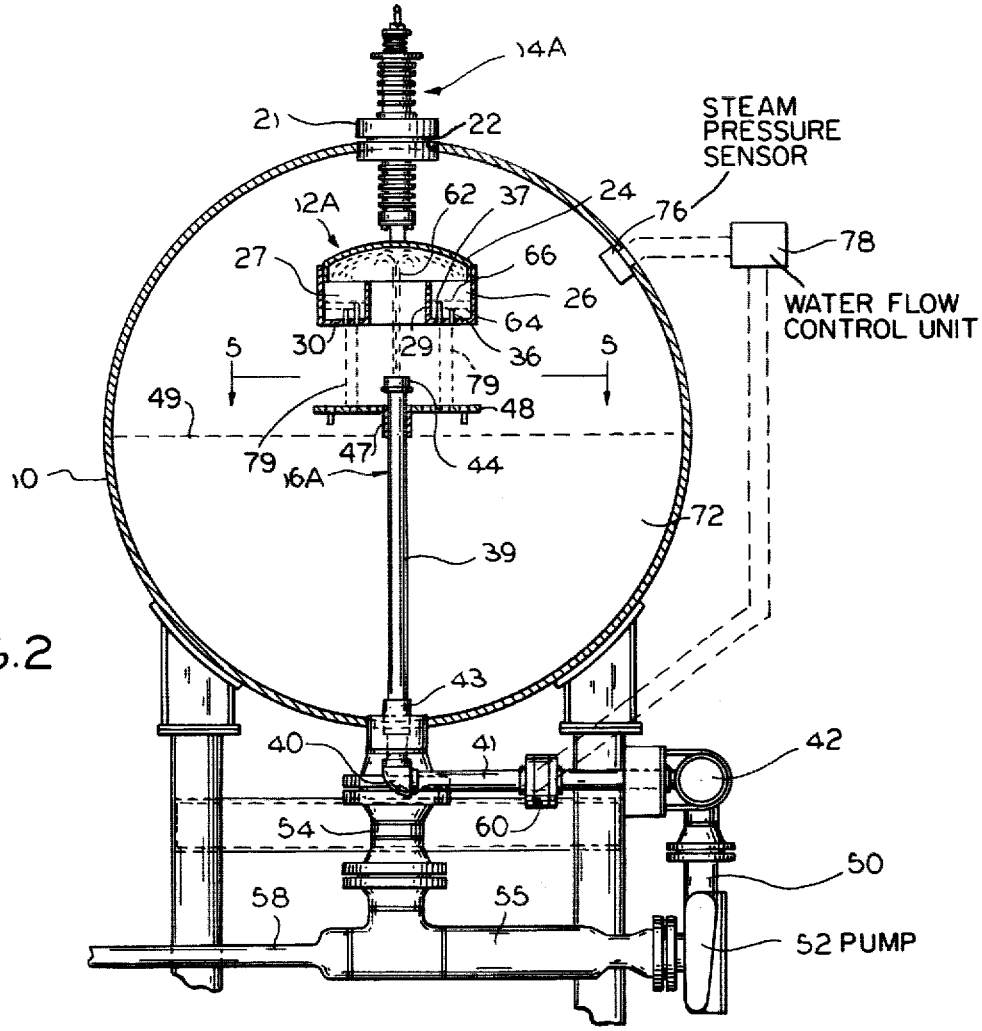
FIG. 2 is an sectional view of the boiler shown in FIG. 1 with parts broken away.
Figure 3:
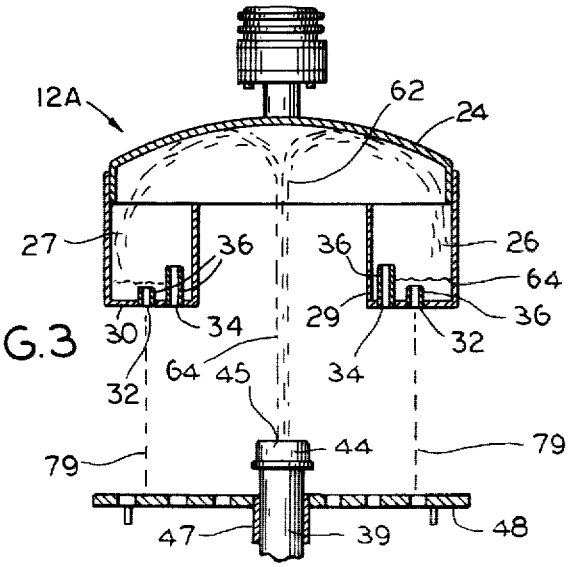
FIG. 3 shows the electrodes of the boiler of FIG. 1 in greater detail.

The electrode 12A is formed of any suitably conductive material, such as mild steel, and is affixed to the lower end of conductor 18A which in turn is suitably fastened within the insulator 14A. As seen in FIGS. 1, 2 and 3, electrode 12A includes a downwardly oriented dome portion 24 which is circular in plain view and a hollow, coaxial annulus 26 suspended below the dome 24 and which is open at its lower end. The annulus 26 thereby defines an annular water containing space 27 having a central opening 29 which is oriented vertically downwardly. The base 30 of the annulus 26 has first and second groups of openings 32 and 34 arranged in concentric circular patterns with the openings 34 disposed radially inwardly of the openings 32. Affixed in registry with each of the openings 32 and 34 are pipe sections 36. As seen in FIG. 3, the pipe sections 36 do not all have the same lengths. Specifically each pipe 36 may have a different length or groups of two or more may be of the same length but different than the lengths of the other groups. Also, if the pipe lengths are arranged in groups of two or more, the common length pipes in each group may be spaced apart.

The counter electrode 16A includes an elongate pipe 39 which extends vertically upwardly from the lower end of vessel 10 and in a coaxial relation relative to the opening 29 in the annulus 24 of electrode 12A. The lower end of pipe 39 is coupled by an elbow 40 and a horizontal pipe 41 to a manifold 42 extending in parallelism with and generally below one side of the vessel 10. The pipes 39 of each of the other counter electrodes 16B and 16C are also connected to manifold 43 in a generally parallel relation. Pipe 39 also includes a fitting 42 affixed in a sealing relation to the lower end of shell 10.

Figure 4:
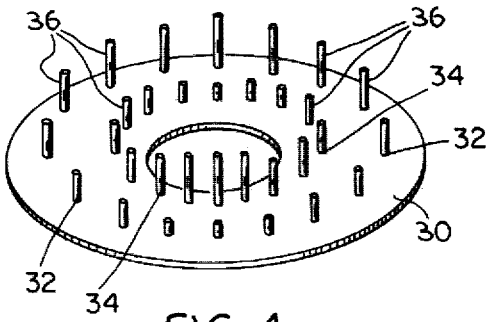
FIG. 4 is a perspective view of a portion one of the upper electrodes shown in FIG. 3.

As seen more particularly in FIGS. 1, 3 and 4, a nozzle 44 is affixed to the upper end of pipe 39 and has a central aperture 45. Below the nozzle 44 a collar 47 is affixed to pipe 39 for supporting a convolute 48 which is coiled outwardly therefrom and which has an outer diameter approximately equal to that of the annulus 26. As seen in FIGS. 1 and 2, the convolute is disposed above the level of water 49 in shell 10.

The manifold 42 is suitably connected by a pipe 50 to the outlet of a constantly running centrifugal pump 52, the inlet of which is connected by pipes 54 and 55 to the lower end of vessel 10. Also connected to the junction between pipes 54 and 55 is a makeup feed water pipe 58, the other end of which is connected to a makeup feed water pump not shown. Disposed in each of the pipes 41 is a flow controller 60 for controlling the flow rate of water from the manifold 41 to each of the pipes 39.

In operation of the boiler in accordance with the preferred embodiment of the present invention, each of the electrodes 12A, 12B and 12C will be suitably energized with one phase of a three phase current system. In addition, the pump 52 will be operated for delivering water at a suitable pressure to each of the pipes 39 so that a vertical column of water 62 is projected upwardly from the opening 45 in nozzle 44, concentrically upwardly through the opening 29 in annulus 26. Dome 24 is generally shaped as a spherical section so that as the water column 62 strikes the dome's inner surface, it is deflected outwardly along the walls of the dome and downwardly into the annular space 27.

The flow controllers 60 are operated such that water will be delivered at a rate which is dependent upon steam loading as reflected by the pressure within the vessel 10. Specifically, a pressure sensor 76 is disposed in vessel 10 for monitoring the pressure therein and for producing an electrical signal functionally related thereto. A control 78 receives this signal and provides a control signal to the controllers 60 for adjusting water flow rate. For example, should the load increase, causing a drop in steam pressure, the water flow rate is increased and conversely water flow rate is decreased in the event of a rise in steam pressure. It will be appreciated that the rate of water flow will govern the height to which the water rises in the spaces 27 of electrodes 12A, 12B and 12C. Because the pipe sections 36 of each electrode 12A, 12B and 12C have different lengths, the level of water in spaces 27 will determine the number of return water streams 79 flowing from each electrode 12A, 12B and 12C to its associated counter electrode 48. It will also be recalled that the electrodes 12A, 12B and 12C are at high voltage and the counter electrodes 48 are connected by pipes 39 to ground or neutral. As a result, phase current will flow from each electrode 12A, 12B and 12C downwardly through the central water columns 62 and in parallel paths through each of the peripheral water columns 79, all of which provide current paths between the high voltage electrodes 12A, 12B and 12C and ground or neutral. In this manner, the number of streams 79 and the flow rate in column 62 determines the water evaporation rates so that control of these parameters will tend to maintain steam pressure within desired limits. For example an increase in steam pressure within vessel 10 will be sensed by sensor 76 which provides an appropriate signal to control 78. An appropriate signal is provided to controller 60 which reduces the flow rates from nozzles 44. As a result, the level of water in the spaces 27 of each electrode 12A, 12B and 12C will decrease to thereby reduce the number of peripheral streams 79. This will decrease the evaporation rate thereby reducing steam pressure. When the pressure set point in control 78 is reached, the flow rates in the central water columns 62 will be stablized. On the other hand, should the pressure in vessel 10 fall below a lower pressure set point of control 76, the water flow rates in the central columns 62 would be increased to increase the water level in the spaces 27 and provide additional peripheral streams 79. As a result, the steam pressure would be increased until a predetermined pressure set point is achieved.

It will be appreciated that as scale begins to form in individual pipes 36, the water flow rate in each will be decreased. In order to compensate, at least some of the pipe sections 36 in each electrode 12A, 12B and 12C extend above the water level in space 27 at the peak power draw. This will provide additional water flow paths as scale begins to form on the inner surfaces of some of the shorter pipes 36. As a result, the total water flow rate can be maintained relatively constant at all load ranges even as some pipes become restricted.

Because all of the water columns in the boiler in accordance with the present invention are vertical, gravitational effects on the water streams 62 and 79 are minimized. Further, because water flow is in the axial direction relative to the electrodes, tangential forces are eliminated thereby simplifying electrode sealing and minimizing troublesome vibrations. Also, because the electrode water flow rates are controlled externally, manufacturing and maintenance costs are reduced. Additionally, the phase currents in each phase of the boiler can be adjusted externally by control of water flow rates thereby further simplifying boiler control and maintenance.

While only a single embodiment of the present invention is illustrated and described, it is not intended to be limited thereby but only by the scope of the appended claims.

We claim:

1. An electric boiler having a vessel for containing a pool of electrically conductive liquid in the lower end thereof, said vessel including a steam outlet, first electrode means disposed within said vessel and adapted to be connected to a high voltage source, second electrode means spaced from and below said first electrode means and above the expected level of the liquid in said pool, said second electrode means including liquid projecting means for projecting electrically conductive liquid upwardly onto said first electrode means in a first continuous stream, means for delivering liquid from the pool to the liquid projecting means of said second electrode means, said first electrode means including liquid receiving means for receiving and collecting the liquid from said first stream and for redirecting the same back downwardly onto said second electrode means in at least one additional continuous stream separate from said first stream and in electrical parallelism therewith, said second electrode means being adapted to be connected into an electric circuit having a low electrical potential relative to said high voltage source whereby an electric current will flow through said liquid streams and through said first and second electrode means without passing through said pool of liquid.

2. The boiler set forth in claim 1 wherein said first stream and said at least one additional stream flow generally vertically and in general parallelism with each other.

3. The boiler set forth in claims 1 or 2 and including means for adjusting the number of said additional streams redirected by said electrode.

4. The boiler set forth in claim 4 wherein said liquid projecting means comprises a nozzle, said means for delivering liquid includes means for withdrawing liquid from the pool and for delivering the same under pressure to said nozzle, and means for selectively adding liquid to said vessel to replenish the pool.

5. The boiler set forth in claim 4 wherein said first electrode is constructed and arranged to provide a plurality of additional streams, the boiler including means for adjusting the flow rate of liquid to said nozzle, and means for adjusting the number of said additional streams in relation to the flow rate of liquid from said nozzle.

6. The boiler set forth in claim 4 wherein said liquid receiving and collecting means includes a plurality of discharge openings disposed at different elevations whereby the number of said additional streams is dependent upon the flow rate of liquid from said nozzle.

7. The boiler set forth in claim 6 wherein said first and additional streams flow vertically.

8. The boiler set forth in claim 7 wherein said first electrode includes first and second portions, said first portion being constructed and arranged for receiving said first stream and redirecting said liquid into said second portion, said second portion being constructed and arranged for collecting said liquid from said first portion and for forming the same into said at least one additional stream.

9. The boiler set forth in claim 8 wherein said openings are defined by a plurality of vertically oriented pipes in said second portion and at least some of which are longer than others.

10. The boiler set forth in claim 9 wherein there are a plurality of first electrodes each connected to a different phase of a polyphase system and each of said second electrodes being connected to a grounded neutral whereby electric currents will not flow through the pool of water contained in said vessel.

11. The boiler set forth in claim 2 wherein said first electrode means includes first and second portions, said first portion being constructed and arranged for receiving said upwardly directed first stream and for redirecting said liquid into said second portion, said second portion being constructed and arranged for collecting said liquid from said first portion and for forming the same into said at least one additional stream which is downwardly directed.

12. The boiler set forth in claim 11 wherein said first portion is generally dome shaped, said second portion having a central opening to permit said first stream to pass therethrough and being located below the periphery of said first portion, said second portion also having a plurality of discharge openings formed in its lower end to permit said liquid to discharge in multiple additional streams onto said second electrode, and a plurality of pipes, one of which extends upwardly from each opening and at least some of said pipes having different lengths, and means for controlling the flow rate of water from said liquid projecting means.

13. The boiler set forth in claim 12 wherein said second electrode includes electrically conductive means extending outwardly from said liquid projecting means and being electrically connected thereto, said electrically conductive means receiving the liquid in said additional streams.

14. The boiler set forth in claim 13 wherein said outwardly extending means has a plurality of gaps formed therein to permit said liquid to pass therethrough for collection in the liquid pool in the lower end of said vessel.

15. The boiler set forth in claim 13 wherein there are a plurality of first electrodes each connected to a different phase of a polyphase system and each of said second electrodes being connected to a grounded neutral whereby electrode currents will not flow through the pool of water contained in said vessel.

16. A method of generating steam comprising the steps of containing a pool of water in a vessel, energizing a first electrode disposed in an upper region of said vessel from a high voltage source, grounding a second electrode disposed within said vessel and spaced below said first electrode, maintaining the level of water in said pool below the elevation of said second electrode, projecting water from the pool generally vertically upward from said second electrode onto said first electrode in a first continuous stream, collecting the water from said first stream at said first electrode and directing the same generally vertically downwardly onto said second electrode in at least one additional continuous stream separate from said first stream but in general parallelism therewith, causing an electric current to flow from said first electrode to said second electrode through said streams in an electrically parallel relation between said high voltage source and ground without passing through said pool for generating steam.

17. The method set forth in claim 16 and including the step of directing said water from said first electrode in multiple generally parallel and continuous streams onto said second electrode.

18. The method set forth in claims 16 or 17 wherein a plurality of first and second electrodes are provided, and connecting each of said first electrodes to a different phase of a polyphase system and connecting each of said second electrodes to a grounded neutral.

19. The method set forth in claim 18 and including the step of adjusting the number of said additional streams.

20. The method set forth in claim 19 and including the step of adjusting the flow rate of liquid in said first stream.

21. An electric boiler having a vessel for containing a quantity of water in a pool in the lower end of the vessel, a first electrode disposed within said vessel and adapted to be connected to a source of electric potential, a second electrode spaced below said first electrode and above the expected level of water in the pool and including a nozzle for directing a continuous column of water from the pool substantially vertically upwardly onto said first electrode, said second electrode being at a different electric potential than said first electrode and having an electrically conductive water receiving portion electrically connected to said nozzle, means for withdrawing water from said pool and delivering the same to said nozzle, said first electrode means including first and second portions, said first portion being positioned to be engaged by said column and being constructed and arranged for redirecting the same onto said second portion, said second portion being constructed and arranged for collecting and forming said water into at least one additional continuous column and redirecting the same downwardly in general parallelism with said first column and onto said water receiving portion.

22. The electric boiler set forth in claim 21 wherein means are provided for providing an adjustable number of said additional columns and means for adjusting the flow rate of water from said nozzle.

* * * * *